US011761598B2

(12) United States Patent
Zhang et al.

(10) Patent No.: US 11,761,598 B2
(45) Date of Patent: Sep. 19, 2023

(54) CANDLE LAMP LIGHT SOURCE AND ELECTRONIC CANDLE LAMP

(71) Applicant: Hangzhou Binary Optoelectronics & Tech Co., Ltd., Zhejiang (CN)

(72) Inventors: Gaole Zhang, Zhejiang (CN); Zhixuan Zhang, Zhejiang (CN); Kang Zhou, Zhejiang (CN)

(73) Assignee: Hangzhou Binary Optoelectronics & Tech Co., Ltd., Zhejiang (CN)

( * ) Notice: Subject to any disclaimer, the term of this patent is extended or adjusted under 35 U.S.C. 154(b) by 0 days.

(21) Appl. No.: 17/850,048

(22) Filed: Jun. 27, 2022

(65) Prior Publication Data

US 2023/0044410 A1 Feb. 9, 2023

(30) Foreign Application Priority Data

Aug. 5, 2021 (CN) ..... 202110896249.5

(51) Int. Cl.
*F21S 10/04* (2006.01)
*F21V 23/06* (2006.01)
*F21Y 115/10* (2016.01)

(52) U.S. Cl.
CPC ..... *F21S 10/043* (2013.01); *F21V 23/06* (2013.01); *F21Y 2115/10* (2016.08)

(58) Field of Classification Search
CPC ..... F21S 10/043; F21S 6/001; F21S 10/04; F21V 23/06; F21V 19/00; F21V 35/00; F21V 35/003; F21Y 2115/10; F21W 2121/002
See application file for complete search history.

(56) References Cited

U.S. PATENT DOCUMENTS

| | | | | |
|---|---|---|---|---|
| 10,605,413 | B1 * | 3/2020 | Dutta | F21K 9/232 |
| 11,009,200 | B1 * | 5/2021 | Ding | F21S 10/043 |
| 2006/0146544 | A1 * | 7/2006 | Leung | F21S 6/001 362/392 |
| 2014/0211499 | A1 * | 7/2014 | Fong | H05B 45/00 362/558 |
| 2016/0146414 | A1 * | 5/2016 | Dong | F21S 6/001 362/372 |
| 2016/0327227 | A1 * | 11/2016 | Green, Jr. | F21V 23/006 |
| 2021/0080070 | A1 * | 3/2021 | Chiang | F21K 9/232 |

FOREIGN PATENT DOCUMENTS

| | | | | |
|---|---|---|---|---|
| WO | WO 2019/105186 | * | 6/2019 | F21S 10/04 |

OTHER PUBLICATIONS

English Translation, WO 2019/105186, Jun. 6, 2019, Inventor—Guo (Year: 2019).*

* cited by examiner

*Primary Examiner* — Peggy A Neils
(74) *Attorney, Agent, or Firm* — IP & T GROUP LLP

(57) ABSTRACT

The present disclosure provides a candle lamp light source and an electronic candle lamp. The candle lamp light source includes a candle lamp body and a plug-in component; the candle lamp body is connected to the plug-in component, the plug-in component is provided with plug-in pins, and the plug-in pins are configured to be detachably connected to a lamp holder. The electronic candle lamp includes the candle lamp light source and the lamp holder.

20 Claims, 7 Drawing Sheets

CANDLE LAMP LIGHT SOURCE AND ELECTRONIC CANDLE LAMP

CROSS-REFERENCE TO RELATED APPLICATION

The present disclosure claims the priority to the Chinese patent application with the filing number 202110896249.5, filed on Aug. 5, 2021 with the Chinese Patent Office, and entitled "Candle Lamp Light Source and Electronic Candle Lamp", the contents of which are incorporated herein by reference in entirety.

TECHNICAL FIELD

The present disclosure relates to the technical field of luminaires, and in particular to a candle lamp light source and an electronic candle lamp.

BACKGROUND ART

Generally, the electronic candles simulate the candle flame in two following modes. One is to simulate the flame effect by controlling brightness and flicker of an LED lamp, and the other is to drive through an electromagnetic force a light source piece to shake, so as to simulate the swinging candle flame. However, the first kind of electronic candle has a dull candle effect and poor effect of imitating burning of the candle flame. For the second kind of electronic candle, as the electromagnetic field and light reflection principle are utilized, the candle piece usually has good effect as being observed on the front, but as the candle piece is of a plane structure, the effect is unfavorable when being observed from the side. Besides, the electronic candle has a complex structure, the brightness of reflected light is usually weak, and the assembling process is also relatively cumbersome.

SUMMARY

An embodiment of the present disclosure provides a candle lamp light source, including a candle lamp body and a plug-in component; and the candle lamp body is connected to the plug-in component, the plug-in component is provided with at least two plug-in pins, and the at least two plug-in pins are configured to be detachably connected to a lamp holder.

In one or more embodiments, the candle lamp body includes: a candle lamp shade and a lamp core, and the candle lamp shade is sleeved outside the lamp core.

In one or more embodiments, a light-emitting surface of the lamp core extends in a circumferential direction of the lamp core, and a central angle corresponding to the light-emitting surface is 360 degrees.

In one or more embodiments, the lamp core includes: a transparent substrate and a plurality of LED chips, the plurality of LED chips are arranged at intervals, and the plurality of LED chips are mounted on the transparent substrate.

An embodiment of the present disclosure further provides an electronic candle lamp, including: a lamp holder and a candle lamp light source, wherein the candle lamp light source includes a candle lamp body and a plug-in component, the candle lamp body is connected to the plug-in component, the plug-in component is provided with at least two plug-in pins, and the plug-in component is detachably connected to the lamp holder through the at least two plug-in pins.

In one or more embodiments, the lamp holder includes: a cell box and an outer shell; and the cell box is mounted inside the outer shell, and the plug-in component is detachably connected to a top portion of the outer shell.

In one or more embodiments, a plug-in socket is mounted on the outer shell, and the plug-in component is detachably inserted into the plug-in socket.

In one or more embodiments, a circuit board is provided in the outer shell, the cell box is connected to the circuit board, and the circuit board is detachably connected to the plug-in socket.

In one or more embodiments, the lamp holder further includes a plug-in flat cable, one end of the plug-in flat cable is connected to the plug-in socket, and the other end of the plug-in flat cable is connected to the circuit board.

In one or more embodiments, the plug-in flat cable includes a first connector, a second connector, and a flat cable connected between the first connector and the second connector, one of the first connector and the second connector is connected to the plug-in socket, and the other is connected to a socket on the circuit board.

In one or more embodiments, the candle lamp shade is detachably connected to the outer shell, or the candle lamp shade is integrally connected to the outer shell to form an integrated structure.

In one or more embodiments, a circuit board provided along a length direction of the outer shell is mounted in the outer shell, and one end of the circuit board close to the plug-in component is provided with a plug-in terminal, and the circuit board is connected to the plug-in component by inserting the plug-in terminal into a bottom of the plug-in socket.

In one or more embodiments, the other end of the circuit board close to the cell box is electrically connected to at least one cell in the cell box through a long electrode.

In one or more embodiments, the outer shell is provided therein with an inner housing formed by splicing a first inner housing and a second inner housing, and the inner housing is sleeved outside the plug-in socket, the circuit board, and the cell box which are sequentially connected.

In one or more embodiments, an upper portion of the plug-in socket is provided with a flange structure having protruding portions provided at intervals in a circumferential direction.

In one or more embodiments, top portions of the first inner housing and the second inner housing are provided with grooves matched with the protruding portions.

In one or more embodiments, the electronic candle lamp further includes a switch assembly provided at the bottom of the inner housing configured to enable on and off of the electronic candle lamp by a pressing action.

In one or more embodiments, a tail cap is sleeved outside the switch assembly, and the tail cap is in threaded connection with the inner housing and further joined (engaged) with the outer shell.

In one or more embodiments, an infrared receiver is mounted on the circuit board, and the infrared receiver is connected to a controller of the candle lamp light source.

In order to make the above objectives, features, and advantages of the present disclosure more apparent and understandable, preferred embodiments are particularly illustrated below in combination with attached accompanying drawings to make following detailed description.

BRIEF DESCRIPTION OF DRAWINGS

In order to more clearly illustrate the technical solutions in specific embodiments of the present disclosure or in the related art, drawings which need to be used in the description of the specific embodiments or the related art will be introduced briefly below, and apparently, the drawings in the description below merely show some embodiments of the present disclosure, and a person ordinarily skilled in the art still could obtain other drawings in light of these drawings without creative efforts.

Figure 1:
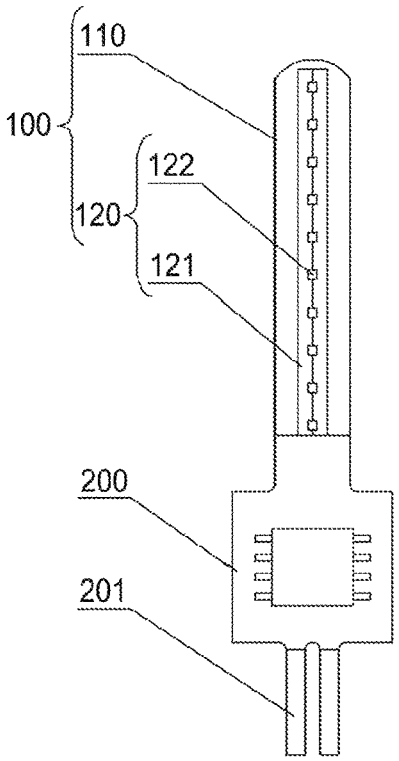
FIG. 1 is a schematic view of a candle lamp light source provided in an embodiment of the present disclosure.

Reference signs: 100—candle lamp body; 110—candle lamp shade; 120—lamp core; 121—transparent substrate; 122—LED chip; 200—plug-in component; 2001—flange structure; 2002—protruding portion; 201—plug-in pin; 220—inner housing; 2201—first inner housing; 2202—second inner housing; 2203—groove; 2204—step-shaped protrusion; 2205—cylindrical projecting structure; 2206—through hole; 2207—clamping groove structure; 221—switch assembly; 222—tail cap; 300—lamp holder; 310—cell box; 3100—cell; 320—outer shell; 321—plug-in socket; 330—circuit board; 3301—recess; 331—plug-in terminal; 334—long electrode; 340—plug-in flat cable; 3401—first connector; 3402—second connector; 3403—flat cable; 350—infrared receiver.

DETAILED DESCRIPTION OF EMBODIMENTS

Technical solutions of the present disclosure will be described dearly and completely below in combination with accompanying drawings, and apparently, the embodiments described are only a part of the embodiments of the present disclosure, rather than all embodiments. Based on the embodiments in the present disclosure, all of other embodiments obtained by a person ordinarily skilled in the art without using creative efforts shall fall within the scope of protection of the present disclosure.

It should be noted that similar reference signs and letters represent similar items in the following accompanying drawings, therefore, once a certain item is defined in one accompanying drawing, it is not needed to be further defined or explained in subsequent accompanying drawings.

In the description of the present disclosure, it should be noted that orientation or positional relationships indicated by terms such as "center", "upper", "lower" "left", "right", "vertical", "horizontal", "inner", and "outer" are based on orientation or positional relationships as shown in the accompanying drawings, merely for facilitating the description of the present disclosure and simplifying the description, rather than indicating or implying that related devices or elements have to be in the specific orientation, or configured and operated in a specific orientation, therefore, they should not be construed as limitation on the present disclosure. Besides, terms "first", "second", and "third" are merely for descriptive purpose, but should not be construed as indicating or implying importance in the relativity. The physical quantities in the formula, if not individually labeled, are to be understood as basic quantities of basic units of the international system of units, or derived quantities derived from the basic quantities by mathematical operations such as multiplication, division, differentiation or integration.

In the description of the present disclosure, it should be noted that unless otherwise specified and defined explicitly, terms "mount", "join", and "connect" should be construed in a broad sense. For example, a connection may be a fixed connection, a detachable connection, or an integral connection; it may be a mechanical connection, or may also be an electrical connection; it may be a direct connection, an indirect connection through an intermediary, or inner communication between two elements. For a person ordinarily skilled in the art, specific meanings of the above-mentioned terms in the present disclosure could be understood according to specific circumstances.

It should be noted that the features in the embodiments of the present disclosure may be combined with each other without conflict.

The candle lamp light source and the electronic candle lamp provided by the present disclosure alleviate the technical problems of complex assembling process and low assembling efficiency of the electronic candle lamps in the prior art, and has good candle flame simulation effect and convenient use.

As shown in FIG. 1, FIG. 2, FIG. 3, and FIG. 4, a candle lamp light source provided in an embodiment of the present disclosure includes: a candle lamp body (i.e., an illuminant part of a lamp core) 100 and a plug-in component (i.e., a circuit part of the lamp core) 200; and the candle lamp body 100 is connected to the plug-in component 200, the plug-in component 200 is provided with plug-in pins 201, and the plug-in pins 201 are configured to be detachably connected to a lamp holder 300.

When the plug-in pin 201 is connected to the lamp holder 300, the plug-in component 200 is in interference fit with the lamp holder 300. The plug-in component 200 can be installed on the lamp holder 300, and the plug-in component 200 can be detached from the lamp holder 300. The candle lamp light source can be used as a replaceable accessory of the electronic candle lamp, and the installation of the candle lamp light source does not need welding, facilitating the assembling and replacement of the candle lamp light source, improving the assembling efficiency, and facilitating mass production. In addition, the plug-in component 200 may be provided as an integrated circuit, so as to integrally install electronic parts and components such as a control chip, and improve the structural compactness of the electrical components of the product.

Figure 2:
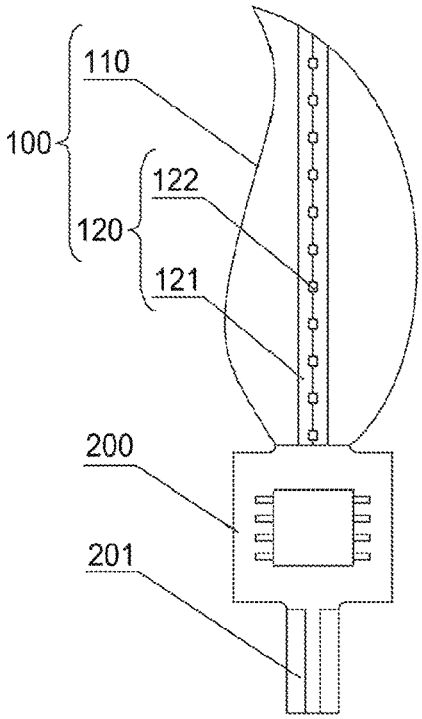
FIG. 2 is a schematic view of another candle lamp light source provided in an embodiment of the present disclosure.
Figure 3:
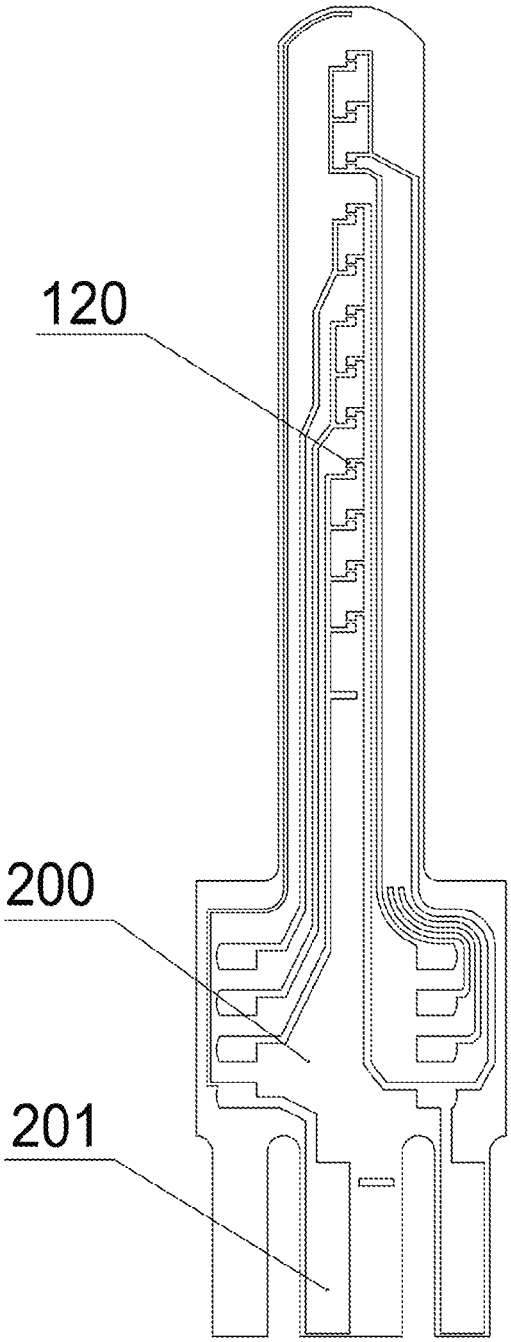
FIG. 3 is a schematic view of a further candle lamp light source provided in an embodiment of the present disclosure.

As shown in FIG. 1, FIG. 2, and FIG. 3, in an embodiment of the present disclosure, the candle lamp body 100 includes: a candle lamp shade 110 and a lamp core 120, and the candle lamp shade 110 is sleeved outside the lamp core 120.

In an optional embodiment, the candle lamp shade 110 is made of a silica gel material, and the candle lamp shade 110 can be made to be in any flame shape to be simulated, so as to ensure that the flame simulation is more vivid. The candle lampshade 110 is sleeved outside the lamp core 120, and the candle lampshade 110 can be detached and replaced as required, so that the candle lampshade 110 with a desired flame shape can be flexibly selected as required.

In an optional embodiment, the lamp core 120 includes: a transparent substrate 121 and a plurality of LED chips 122, wherein the plurality of LED chips 122 are arranged at intervals, and the plurality of LED chips 122 are mounted on the transparent substrate 121. In an optional embodiment, the transparent substrate 121 is a light-transmitting PCB board. In an optional embodiment, a plurality of LED chips 122 are attached to one side of transparent substrate 121. Through such design, the LED chips are matched with the transparent substrate, then the light-emitting effect of 360 degrees without shielding can be realized, that is, the effects that a light-emitting surface of the lamp core 120 extends in a circumferential direction of the lamp core 120 and a central angle corresponding to the light-emitting surface is 360 degrees can be realized.

In the present embodiment, the lamp core 120 can realize all-orientation lighting of 360 degrees, similar to the 360-degree light-emitting effect of real candle flame, and close to the real candle flame no matter being observed from which viewing angle.

Specifically, the lamp core 120 can be subjected to programmable controlling by a control chip, so that the number of the LED chips 122 to be lighted and the order of lighting the LED chips 122 can be selected, thus, various flame combustion effects can be simulated according to specific requirements, such as flame flickering, flame swing, and upward fleeing of flame.

Figure 4:
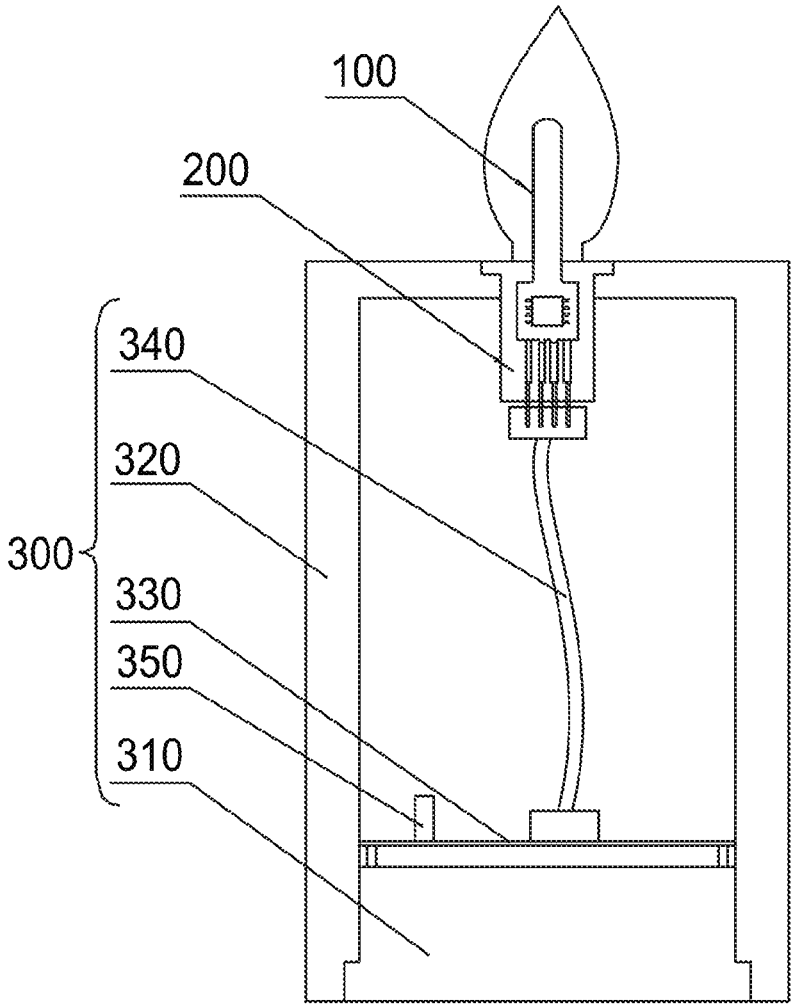
FIG. 4 is a schematic view of an electronic candle lamp provided in an embodiment of the present disclosure.
Figure 5:
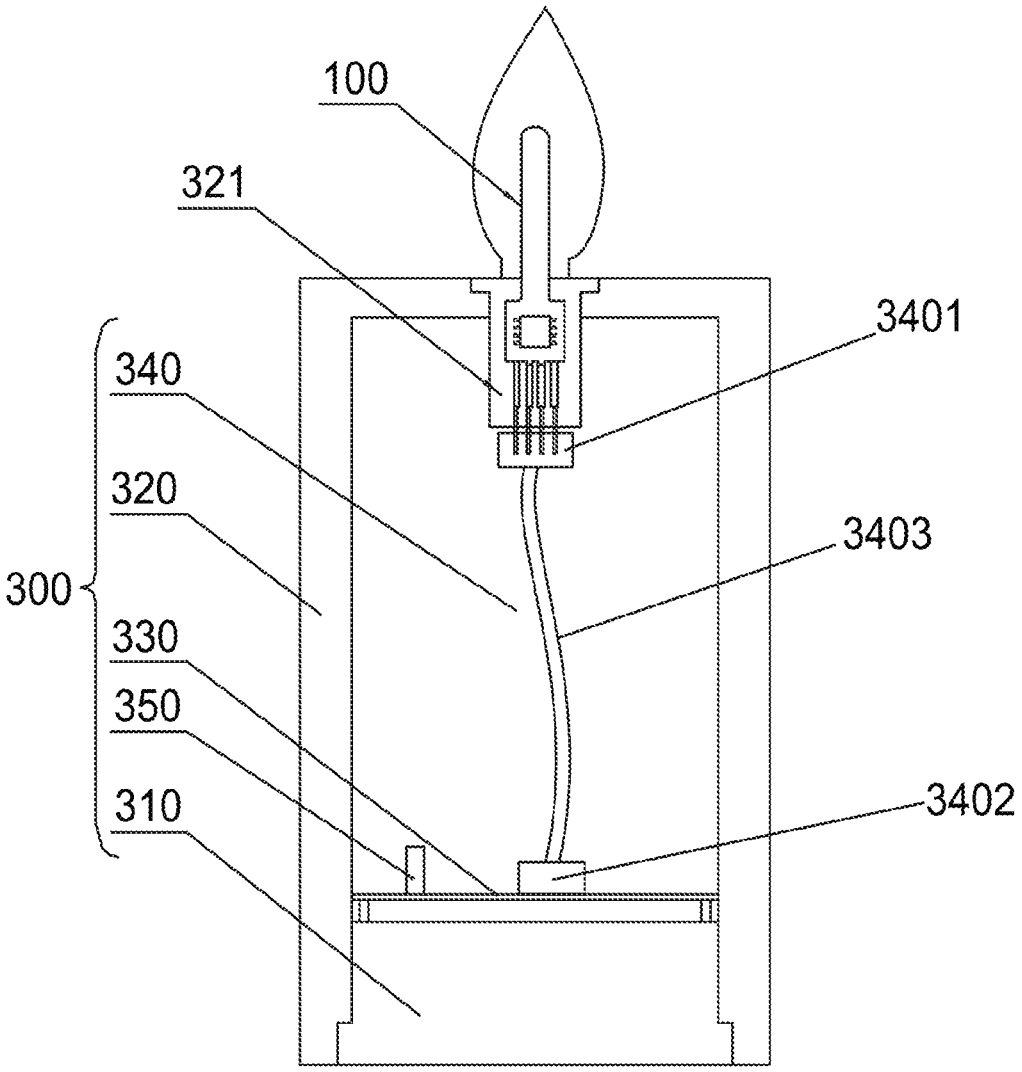
FIG. 5 is a schematic view of another electronic candle lamp provided in an embodiment of the present disclosure.

As shown in FIG. 1, FIG. 4, and FIG. 5, an electronic candle lamp provided in an embodiment of the present disclosure includes: a lamp holder 300 and the candle lamp light source as described above, wherein a plug-in component 200 is detachably connected to the lamp holder 300.

In the embodiment of the present disclosure, the plug-in component 200 is detachably connected to the lamp holder 300 in a plug-in manner, so as to facilitate the disassembling and replacement of the candle lamp light source. When the candle lamp light source is worn, the candle lamp light source can be replaced, so that the lamp holder 300 is continuously used, avoiding unnecessary resource waste.

Further, the lamp holder 300 includes: a cell box 310 and an outer shell 320; and the cell box 310 is mounted inside the outer shell 320, and the plug-in component 200 is detachably connected to the top portion of the outer shell 320.

In an optional embodiment, the candle lamp shade 110 of the candle lamp light source may be detachably connected to the outer shell 320.

In an optional embodiment, the candle lamp shade 110 of the candle lamp light source may be integrally connected to the outer shell 320, forming an integrated structure.

In an optional embodiment, the cell box 310 is mounted at the bottom of the outer shell 320, a cell 3100 may be mounted inside the cell box 310, the candle lamp light source is powered by the cell 3100 in the cell box 310, and the plug-in component 200 is detachably connected to the outer shell 320 in a plug-in manner.

In an optional embodiment, the cell box 310 is in threaded connection with the outer shell 320. An external thread is provided on an outer side wall of the cell box 310, an internal thread is provided on an inner side wall of the outer shell 320 dose to the bottom, such that threaded connection between the cell box 310 and the bottom of the outer shell 320 is achieved through the external thread and the internal thread.

As shown in FIG. 5, a plug-in socket 321 is mounted on the outer shell 320, and the plug-in component 200 is detachably inserted into the plug-in socket 321.

In an optional embodiment, the outer shell 320 may be of an integrated structure, or the plug-in socket 321 may be separated from the housing, the plug-in socket 321 is provided with a jack adapted to the plug-in component 200, and the plug-in component 200 is installed on the plug-in socket 321 in a plug-in manner.

As shown in FIG. 4 and FIG. 5, a circuit board 330 provided in a direction perpendicular to a length direction of the outer shell 320 is provided in the outer shell 320, the cell box 310 is connected to the circuit board 330, and the circuit board 330 is detachably connected to the plug-in socket 321.

Specifically, the circuit board 330 is connected to the outer shell 320 or an inner housing 220, or the circuit board 330 is connected to the cell box 310, the cell in the cell box 310 is electrically connected with the circuit board 330, and the circuit board 330 is electrically connected with the plug-in pin 201, so as to supply power to the candle lamp light source.

Further, the lamp holder 300 further includes a plug-in flat cable 340, wherein one end of the plug-in flat cable 340 is connected to the plug-in socket 321, and the other end of the plug-in flat cable 340 is connected to the circuit board 330.

Specifically, the plug-in flat cable 340 includes: a first connector 3401, a second connector 3402, and a flat cable 3403, wherein the flat cable is connected between the first connector 3401 and the second connector 3402, one of the first connector 3401 and the second connector 3402 is connected to the plug-in socket 321, the other of the first connector 3401 and the second connector 3402 is connected to a socket on the circuit board 330. The plug-in flat cable 340 being disassembled/assembled in the plug-in manner facilitates the assembling and maintenance.

In an optional embodiment, an infrared receiver 350 is mounted on the circuit board 330, and the infrared receiver 350 is connected to a controller of the candle lamp light source. In an optional embodiment, the controller may be a remote controller. By using the infrared receiver 350 to receive a control signal of the remote controller, a light-emitting mode and/or light-emitting time of the candle lamp light source can be adjusted in a remote control manner, so as to simulate a desired candle flame effect, and set the light-emitting time of the candle lamp as required, realizing the remote control or timing function.

Figure 6:
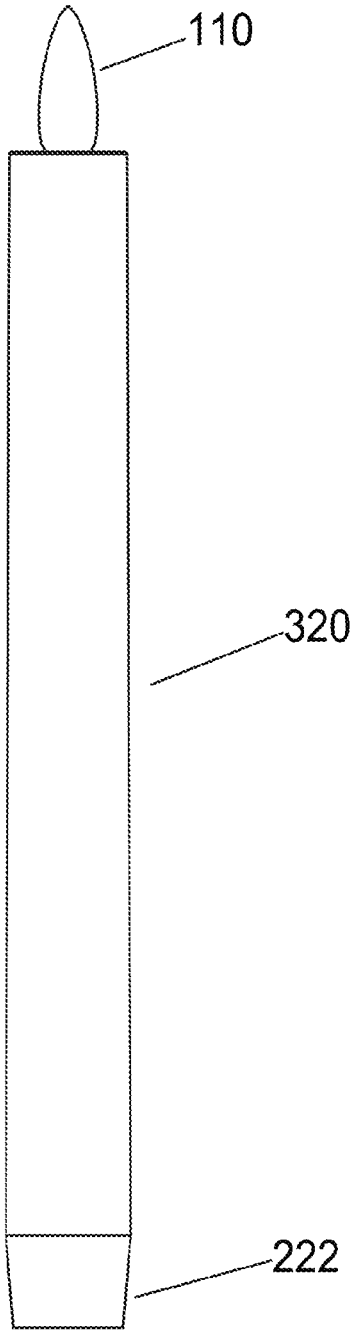
FIG. 6 is a perspective structural view of a further electronic candle lamp provided in an embodiment of the present disclosure.
Figure 7:
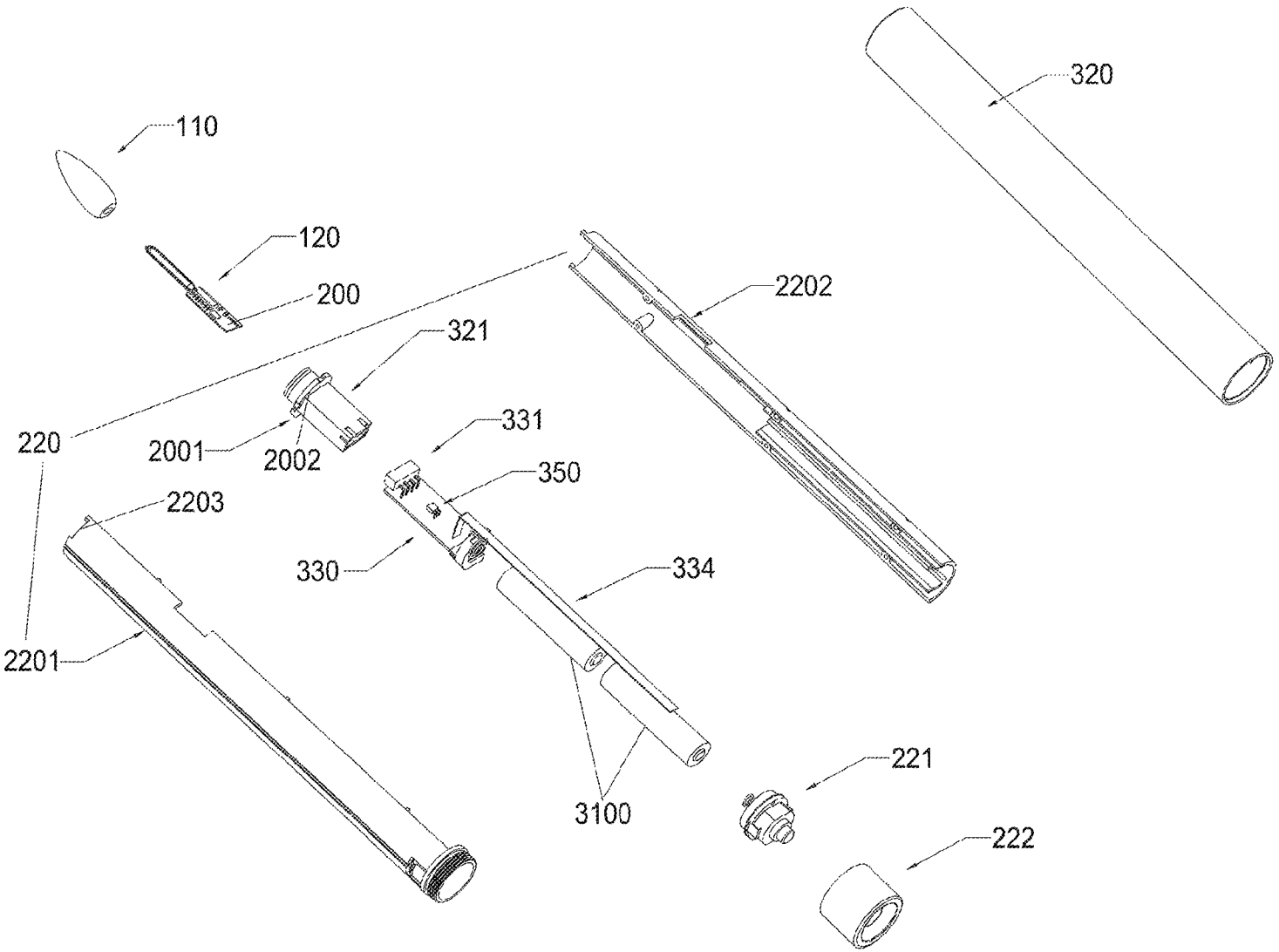
FIG. 7 is an exploded view of a further electronic candle lamp provided in an embodiment of the present disclosure.
Figure 8:
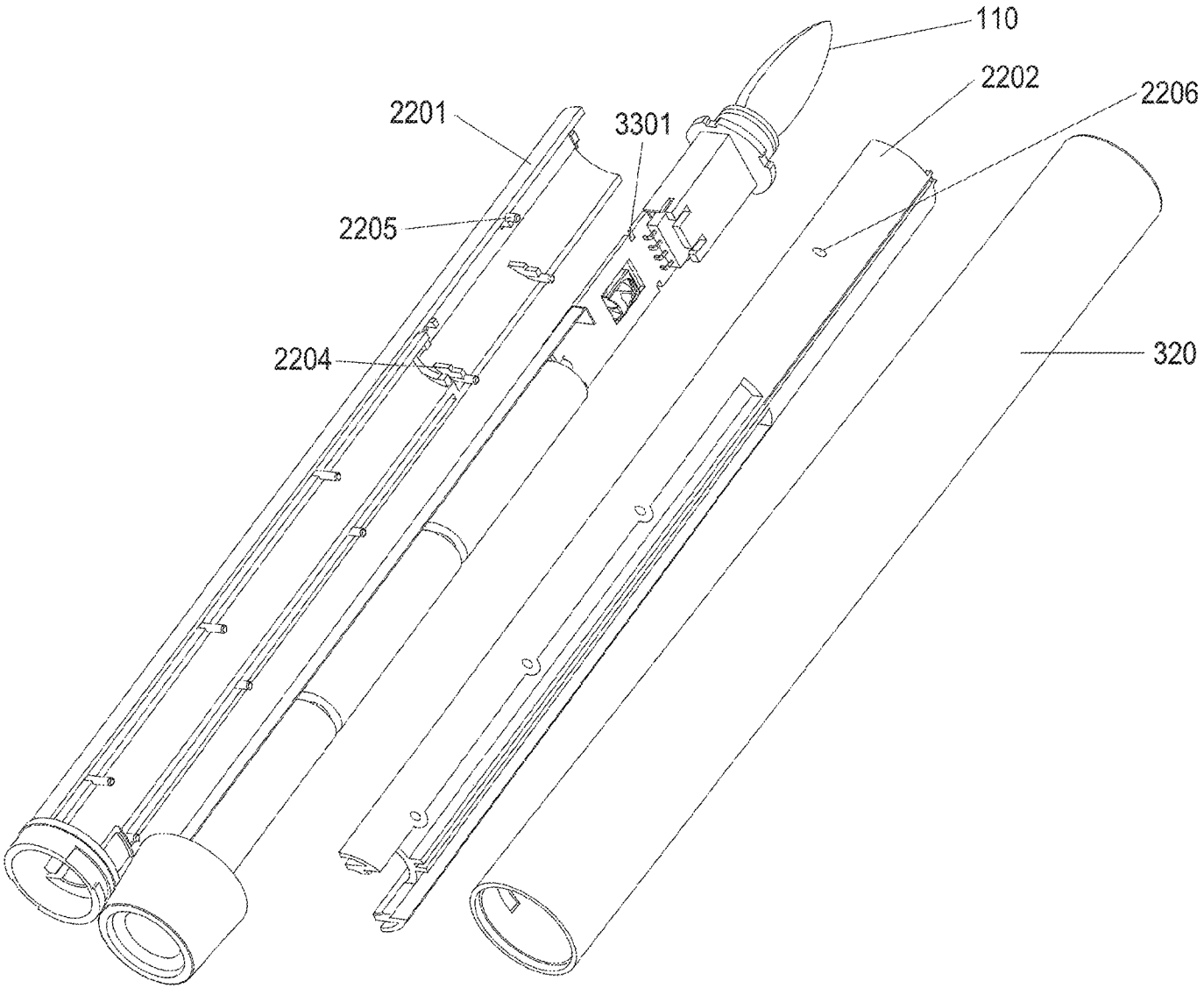
FIG. 8 is another exploded view of a further electronic candle lamp provided in an embodiment of the present disclosure.

As shown in FIGS. 6-8, in an optional embodiment, the outer shell 320 is provided therein with an inner housing 220 detachably or integrally. The inner housing 220 is formed by splicing two parts, i.e. a first inner housing 2201 and a second inner housing 2202, and is sleeved outside the plug-in socket 321, the circuit board 330, and the cell box 310 which are sequentially connected from top to bottom (namely, along the direction from the lamp core of the electronic candle lamp to the bottom of the electronic candle lamp). Cross-sections of the first inner housing 2201 and the second inner housing 2202 are semi-circular. Optionally, an upper portion of the plug-in socket 321 is provided with a flange structure 2001 having protruding portions 2002 provided at intervals in a circumferential direction. Top portions of the first inner housing 2201 and the second inner housing 2202 are provided with grooves 2203 matched with the protruding portions 2002. Through cooperation between the protruding portions 2002 of the flange structure 2001 and the grooves 2203 at the top portions of the first inner housing 2201 and the second inner housing 2202, the connection between the plug-in socket 321 and the inner housing 220 is realized. This structure is simple, easy to detach, and stable in connection.

In an optional embodiment, the circuit board 330 is provided along a length direction of the inner housing 220 (that is, a length direction of the outer shell 320), and is provided with a plug-in terminal 331 at one end dose to the plug-in socket 321. By inserting the plug-in terminal 331 into the bottom of the plug-in socket 321, the connection between the plug-in component 200 and the circuit board 330 can be realized. The other end of the circuit board 330 dose to the cell box 310 is electrically connected to the cell 3100 in the cell box 310 through a long electrode 334.

In an optional embodiment, recesses 3301 are respectively provided on two lateral sides of the circuit board 330, step-shaped protrusions 2204 corresponding to the recesses 3301 and capable of being snap-fitted with the recesses 3301 are provided on an inner side wall of the first inner housing 2201, and through the snap-fitting between the recesses 3301 and the corresponding step-shaped protrusions 2204, the circuit board 330 can be stably fixed inside the inner housing 220.

In an optional embodiment, a plurality of cylindrical projecting structures 2205 are provided on two lateral sides of the first inner housing 2201, and through holes 2206 are provided at portions of two lateral sides of the second inner housing 2202 corresponding to the cylindrical projecting structures 2205 of the first inner housing 2201. By inserting the cylindrical projecting structures 2205 into the corresponding through holes 2206, the first inner housing 2201 and the second inner housing 2202 can be connected together.

In an optional embodiment, an infrared receiver is mounted on the circuit board, and the infrared receiver is connected to the controller of the candle lamp light source.

In an optional embodiment, a switch assembly 221 configured to enable on and off of the electronic candle lamp by a pressing action is further provided at the bottom of the inner housing 220, and a tail cap 222 is sleeved outside the switch assembly 221. In an optional embodiment, the tail cap 222 is provided with an internal thread on an inner side thereof, and can be in threaded connection with the bottom of the inner housing 220, that is, the tail cap 222 can be in threaded connection with the inner housing and further joined with the outer shell 320. With such configuration, components such as the candle lamp light source and the cells are convenient to disassemble and replace, and the candle lamp can be used by simply pressing the switch.

Finally, it should be explained that the various embodiments above are merely used for illustrating the technical solutions of the present disclosure, rather than limiting the present disclosure. Although the detailed description is made to the present disclosure with reference to various preceding embodiments, those ordinarily skilled in the art should understand that they still could modify the technical solutions recited in various preceding embodiments, or make equivalent substitutions to some or all of the technical features therein; and these modifications or substitutions do not make the corresponding technical solutions essentially depart from the scope of the technical solutions of various embodiments of the present disclosure.

INDUSTRIAL APPLICABILITY

The candle lamp light source and the electronic candle lamp of the present disclosure includes the candle lamp body and the plug-in component, the candle lamp body is connected to the plug-in component, the plug-in component is provided with at least two plug-in pins, and the at least two plug-in pins are configured to be detachably connected to the lamp holder. By means of such a design, the present disclosure does not need to assemble the candle lamp light source by means of excessive welding, facilitating disassembling and replacing of the candle lamp light source, and alleviating the technical problems of complex assembling process and low assembling efficiency of the electronic candle in the prior art; in addition, the lamp shade of the electronic candle lamp of the present disclosure is made of a silica gel material, and can be made to be in the flame shape to be simulated, thereby ensuring that the flame simulation is more vivid, the candle flame simulation effect is good, and the use is convenient.

What is claimed is:

1. A candle lamp light source, comprising: a candle lamp body and a plug-in component, wherein the candle lamp body is connected to the plug-in component, the plug-in component is provided with at least two plug-in pins, and the at least two plug-in pins are configured to be detachably connected to a lamp holder, wherein the plug-in component is provided as an integrated circuit, so as to integrally install electronic parts and components, wherein the lamp holder comprises: an outer shell, wherein the outer shell is provided therein with an inner housing formed by splicing a first inner housing and a second inner housing; and a circuit board is provided in the outer shell, wherein recesses are respectively provided on two lateral sides of the circuit board, step-shaped protrusions corresponding to the recesses and capable of being snap-fitted with the recesses are provided on an inner side wall of the first inner housing.

2. The candle lamp light source according to claim 1, wherein the candle lamp body comprises: a candle lamp shade and a lamp core, and the candle lamp shade is sleeved outside the lamp core.

3. The candle lamp light source according to claim 2, wherein a light-emitting surface of the lamp core extends in a circumferential direction of the lamp core, and a central angle corresponding to the light-emitting surface is 360 degrees.

4. The candle lamp light source according to claim 2, wherein the lamp core comprises: a transparent substrate and a plurality of LED chips, the plurality of LED chips are arranged at intervals, and the plurality of LED chips are mounted on the transparent substrate.

5. An electronic candle lamp, comprising a lamp holder and a candle lamp light source, wherein the candle lamp light source comprises a candle lamp body and a plug-in component, the candle lamp body is connected to the plug-in component, the plug-in component is provided with at least two plug-in pins, and the plug-in component is detachably connected to the lamp holder through the at least two plug-in pins, wherein the plug-in component is provided as an integrated circuit, so as to integrally install electronic parts and components, wherein the lamp holder comprises: an outer shell, wherein the outer shell is provided therein with an inner housing formed by splicing a first inner housing and a second inner housing; and a circuit board is provided in the outer shell, wherein recesses are respectively provided on two lateral sides of the circuit board, step-shaped protrusions corresponding to the recesses and capable of being snap-fitted with the recesses are provided on an inner side wall of the first inner housing.

6. The electronic candle lamp according to claim 5, wherein the lamp holder further comprises: a cell box; and the cell box is mounted inside the outer shell, and the plug-in component is detachably connected to a top portion of the outer shell.

7. The electronic candle lamp according to claim 6, wherein the outer shell is provided with a plug-in socket, and the plug-in component is detachably inserted into the plug-in socket.

8. The electronic candle lamp according to claim 7, wherein the cell box is connected to the circuit board, and the circuit board is detachably connected to the plug-in socket.

9. The electronic candle lamp according to claim 8, wherein the lamp holder further comprises a plug-in flat cable, one end of the plug-in flat cable is connected to the plug-in socket, and the other end of the plug-in flat cable is connected to the circuit board.

10. The electronic candle lamp according to claim 9, wherein the plug-in flat cable comprises a first connector, a second connector, and a flat cable connected between the first connector and the second connector, one of the first connector and the second connector is connected to the plug-in socket, and the other is connected to a socket on the circuit board.

11. The electronic candle lamp according to claim 8, wherein an infrared receiver is mounted on the circuit board, and the infrared receiver is connected to a controller of the candle lamp light source.

12. The electronic candle lamp according to claim 6, wherein the candle lamp shade is detachably connected to the outer shell, or the candle lamp shade is integrally connected to the outer shell to form an integrated structure.

13. The electronic candle lamp according to claim 6, wherein a circuit board provided along a length direction of the outer shell is mounted in the outer shell, wherein one end of the circuit board close to the plug-in socket is provided with a plug-in terminal, and the circuit board is connected to the plug-in component by inserting the plug-in terminal into a bottom of the plug-in socket.

14. The electronic candle lamp according to claim 13, wherein the other end of the circuit board close to the cell box is electrically connected to at least one cell in the cell box through a long electrode.

15. The electronic candle lamp according to claim 13, wherein the inner housing is sleeved outside the plug-in socket, the circuit board, and the cell box which are sequentially connected.

16. The electronic candle lamp according to claim 15, wherein an upper portion of the plug-in socket is provided with a flange structure having protruding portions provided at intervals in a circumferential direction.

17. The electronic candle lamp according to claim 16, wherein top portions of the first inner housing and the second inner housing are provided with grooves matched with the protruding portions.

18. The electronic candle lamp according to claim 15, further comprising a switch assembly provided at the bottom of the inner housing configured to enable on and off of the electronic candle lamp by a pressing action.

19. The electronic candle lamp according to claim 18, wherein a tail cap is sleeved outside the switch assembly, and the tail cap is in threaded connection with the inner housing and further joined with the outer shell.

20. The electronic candle lamp according to claim 13, wherein an infrared receiver is mounted on the circuit board, and the infrared receiver is connected to a controller of the candle lamp light source.

* * * * *